US005259602A

United States Patent [19]

Rogos

[11] Patent Number: 5,259,602

[45] Date of Patent: Nov. 9, 1993

[54] STAND FOR FRONT WHEEL DRIVE TRANSMISSIONS

[76] Inventor: Donald D. Rogos, R.D. #2, Box 521, Brockway, Pa. 15824

[21] Appl. No.: 967,235

[22] Filed: Oct. 27, 1992

[51] Int. Cl.[5] ..... B66F 3/00

[52] U.S. Cl. ..... 269/17; 269/47; 269/79; 269/82; 269/71

[58] Field of Search ..... 269/17, 71, 69, 70, 269/79, 47, 50, 51, 82; 254/134, DIG. 16

[56] References Cited

U.S. PATENT DOCUMENTS

| | | | |
|---|---|---|---|
| 2,976,033 | 3/1961 | Martin | 269/17 |
| 3,106,111 | 10/1963 | Denisco | 269/71 |
| 3,168,893 | 2/1965 | Johnson | 269/71 |
| 3,700,228 | 10/1972 | Peale | 269/71 |
| 4,010,942 | 3/1977 | Ward . | |
| 4,095,778 | 6/1978 | Wing | 269/71 |
| 4,145,006 | 3/1979 | Webb | 269/71 |
| 4,307,877 | 12/1981 | Rogos . | |
| 4,533,127 | 8/1985 | Hawkins | 269/17 |
| 4,560,151 | 12/1985 | Grundy . | |
| 4,691,904 | 9/1987 | Armstrong . | |

*Primary Examiner*—Robert C. Watson

*Attorney, Agent, or Firm*—Jacobson, Price, Holman & Stern

[57] ABSTRACT

A transmission stand for supporting front wheel drive transmissions. The transmission stand comprises a framework having a head portion, a base portion and at least two legs projecting forward from the base portion for stabilizing the transmission stand when the transmission stand is upright. Each of the legs includes a distal tip which acts as a fulcrum when the transmission stand is rotated from a generally horizontal position to an upright position and vice versa. The transmission stand further comprises attachment device pivotally mounted to the head portion of the framework, and pivotally adjustable about a pivot axis from a position generally forward of the head portion to a position generally on top of the head portion. The attachment device further includes support for supporting the bell housing of a transmission. According to a preferred embodiment, the support for the bell housing is rotatably mounted on the attachment device such that the support can rotate about a rotation axis. Preferably, the rotation axis remains perpendicular to the pivot axis. In addition, to accommodate a plurality of different transmissions, an adaptor plate is provided for adapting the transmission stand to different bell housings. A leverage bar is also provided for assisting a mechanic whenever the attachment device is to be pivoted from one position to another. Also provided, is at least one wheel to facilitate "dollying" of the transmission.

16 Claims, 2 Drawing Sheets

STAND FOR FRONT WHEEL DRIVE TRANSMISSIONS

BACKGROUND OF THE INVENTION

The present invention relates to a stand for raising, dollying, and supporting front wheel drive transmissions.

Automotive transmissions are typically heavy and therefore require a great deal of effort to lift and carry. In the past, transmissions have been lifted and carried manually or by using hoists attached to a ceiling. Unfortunately, these methods are very restrictive. In the case of manual lifting, the mechanic is subjected to a great deal of back strain which, in turn, can lead to debilitating injuries. The mechanic is likewise limited by his own strength when carrying the transmission to a remote place. A hoist, on the other hand, is usually expensive and restricted in that it must be hung from a ceiling and is therefore limited to the area covered by tracks on the ceiling. Other hoists are more portable, but expensive and involve large, cumbersome structures.

More recent attempts to provide a mobile stand for a transmission are disclosed in U.S. Pat. Nos. 4,560,151 to Grundy; 4,691,904 to Armstrong; 4,010,942 to Ward; and 4,307,877 to the present applicant. Although generally effective, each of the disclosed stands, is designed for rear wheel drive transmissions having a long rearwardly projecting barrel portion which eventually connects to a drive shaft. Consequently, none of these references suggests a stand for supporting a front wheel drive transmission, nor do they suggest supporting a transmission by its bell housing alone.

SUMMARY OF THE INVENTION

It is a primary object of the present invention to overcome the disadvantages of the prior art by providing a transmission stand which can be used to lift a front wheel drive transmission from the ground and to thereafter support the transmission in one of a plurality of orientations to thus permit easy access to any side of the transmission for purposes of repair or rebuilding.

In order to achieve this and other objects, the transmission stand of the present invention comprises a framework having a head portion, a base portion and at least two leg means projecting forward from the base portion for stabilizing the transmission stand when the transmission stand is upright. Each of the leg means includes a distal tip which acts as a fulcrum when the transmission stand is rotated from a generally horizontal position to an upright position and vice versa. The transmission stand further comprises attachment means pivotally mounted to the head portion of the framework, and pivotally adjustable about a pivot axis from a position generally forward of the head portion to a position generally on top of the head portion. The attachment means further includes means for supporting the bell housing of a transmission.

According to a preferred embodiment of the present invention, the means for supporting the bell housing is rotatably mounted on the attachment means such that the means for supporting the bell housing can rotate about a rotation axis. Preferably, the rotation axis remains perpendicular to the above-mentioned pivot axis.

Also according to a preferred embodiment, the attachment means of the transmission stand includes a tubular member, and the means for supporting the bell housing comprises a shaft rotatably received in the tubular member; a disk fixedly mounted to a forward end of the shaft; an elbow comprising a biceps portion and a forearm portion, the biceps portion being mounted on the disk while the forearm portion projects perpendicularly away from disk; and a transmission supporting bar connected to the forearm portion of elbow.

To accommodate a plurality of different transmissions, the present invention also includes an adaptor plate for adapting the transmission stand to different bell housings.

In addition, a leverage bar is provided which assists the mechanic whenever the attachment means is to be pivoted from one position to another, and at least one wheel is provided to facilitate "dollying" of the transmission.

DETAILED DESCRIPTION OF A PREFERRED EMBODIMENT

Figure 1:
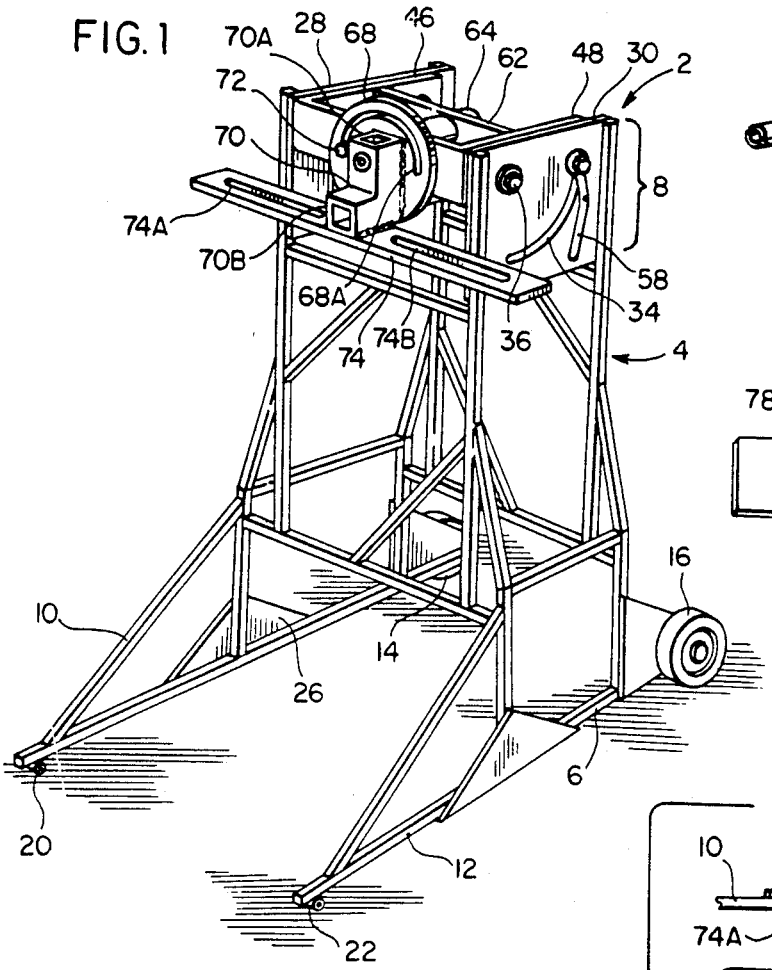
FIG. 1 is a perspective view of a preferred embodiment of the transmission stand of the present invention.

With reference to FIGS. 1–8, a preferred embodiment of the transmission stand of the present invention will now be described.

In order to accommodate front wheel drive transmissions, a preferred transmission stand 2 comprises a generally rectangular framework 4 having a base portion 6 and a head portion 8; a pair of leg members 10 and 12 generally connected to the base portion 6 and extending forward of the framework 4; a pair of rear wheels 14 and 16 mounted laterally to the base portion 6 and opposite from the leg members 10 and 12; and a pivotally mounted attachment means 18.

The pair of leg members 10 and 12 preferably comprise a generally triangular arrangement with a rubber pad 20, 22 located distally at the forward most end of each leg member 10 and 12. According to an alternative embodiment, a pair of small castor wheels can replace the rubber pads 20, 22.

The framework 4 preferably comprises a plurality of steel bars, each having a square cross section and hollow interior. The bars are preferably welded to one another so as to provide a rigid structure capable of supporting at least the weight of a typical automotive transmission 24. The weld points can be further reinforced, as is shown in the drawings, using reinforcement plates 26. It should be noted, however, that the present invention is not limited to the illustrated construction.

For example, the materials used to manufacture the framework 4 can include rigid plastics, aluminum, wood, etc. The cross section of the bars is likewise not limited to square and hollow, but can include any other shape or can be solid. Furthermore, the framework's bars need not be welded to one another, but may be secured in any manner known to the art.

With regard to the head portion 8 of the framework 4, the lateral sides of the head portion 8 are defined by two substantially parallel head plates 28 and 30, each of the head plates 28 and 30 having a hole 32 and an arced slot 34. The hole 32 in each head plate 28 and 30 is disposed toward the upper front corner of the head plate 28 and 30 and is designed to receive a pivot pin 36. Each pivot pin 36 is secured in its respective hole 32 using a cotter pin or similar arrangement. That is, each pivot pin 36 includes a hole drilled laterally through the distal end of the pivot pin 36 for receiving a cotter pin or similar clip therethrough. The drawings illustrate a conventional clip 38 which resembles a cotter pin, but one side 40 of the clip 38 engages the circumference of the pivot pin 36, while the other side 42 passes through the laterally drilled hole. In the case of a cotter pin, the distal ends of each cotter pin are split and wrapped circumferentially around the pivot pin 36 to prevent the cotter pin from falling out and to secure the pivot pin 36 to the head plate 28 and 30 while at the same time permitting rotation of the pivot pin 36. Preferably, each arced slot 34 subtends an angle of at least 90 degrees.

With regard to the attachment means 18, a U-shaped bracket 44 having two substantially parallel branches 46 and 48 is pivotally mounted between the two head plates 28 and 30. The U-shaped bracket 44 includes a total of four holes 50, 52, 54, and 56, two holes being disposed on each branch 46 and 48 of the bracket 44. The two holes 50 and 52 mounted closest to the connection of the two branches 46 and 48 (i.e., base of the "U") are designated as pivot holes 50 and 52 because each is designed to receive the pivot pin 36. A pivotal mounting of the U-shaped bracket 44 about a pivot axis P is thus achieved using the pivot pins 36.

The other two holes 54 and 56 of the U-shaped bracket 44 are threaded and positioned distally near the end of each branch 46 and 48. Accordingly, these holes 54 and 56 are hereinafter referred to as the distal holes 54 and 56. The distance separating the pivot holes 50 and 52 from the distal holes 54 and 56 at the end of each branch 46 and 48 is the same as the radial distance separating the hole 32 of each head plate 28 and 30 from the corresponding arced slot 34. A handled bolt 58 is received though the arced slots 34, by each of the threaded distal holes 54 and 56 of the U-shaped bracket 44. In particular, the handled bolt 58 is arranged coaxially with a washer means 60 such that tightening of the handled bolt 58 results in squeezing the head plate 28 or 30 between the washer means 60 and the corresponding branch 46 or 48 of the U-shaped bracket 44. The handled bolt 58 and the arced slot 34 therefore cooperate to allow the U-shaped bracket 44 to be secured to the head portion 8 in any desired angular orientation with respect to the framework 4.

Mounted transversely across the U-shaped bracket 44, is a cross beam 62. The cross beam 62 provides support for one end of a tubular member 64 which bisects the U-shaped bracket 44. The other end of the tubular member 64 is supported by the base of the U-shaped bracket 44.

A shaft 66 is rotatably received within the tubular member 64 and extends beyond both ends thereof. The shaft 66 is rotatable about the rotation axis R shown in FIG. 3. The forward end 66A of the shaft 66 (the end extending beyond the base of the U-shaped bracket 44) is securely connected, through a disk member 68, to an elbow 70. The elbow 70 itself comprises a biceps portion 70A and a forearm portion 70B, both portions 70A and 70B being hollow and having a substantially square cross section. The biceps portion 70A is defined as that part of the elbow 70 which is mounted flush against the disk member 68, while the forearm portion 70B projects perpendicularly with respect to the disk member 68. The disk member 68, much like the head plates 28 and 30, includes an arced slot 68A, but here the arced slot 68A subtends an angle of at least 180 degrees.

A disk-tightening bolt 72 passes through the arced slot 68A in the disk member 68 and is threadedly received in the base portion of the U-shaped bracket 44. When tightened by clockwise rotation, the disk-tightening bolt 72 squeezes the disk member 68 against the base of the U-shaped bracket 44, thus causing frictional engagement between the disk member 68 and base of the U-shaped bracket 44. This frictional engagement prevents rotation of the shaft 66 with respect to the tubular member 64. Rotation of the shaft 66 is selectively achieved by loosening the disk-tightening bolt 72 using counter-clockwise rotation, rotating the disk 68 and shaft 66 to a desired angular orientation with respect to the tubular member 64, and subsequently tightening the bolt 72 when the desired arrangement is achieved.

The attachment means 18 further comprises an elongated transmission support bar 74 mounted flush against the forearm portion 70B of the elbow 70. Preferably, the elongated transmission support bar 74 is connected by its longitudinal center to the elbow 70, the transmission support bar 74 further comprising two elongated slots 74A and 74B disposed on each side of the elbow 70 and extending toward the ends of the support bar 74.

Figure 4:
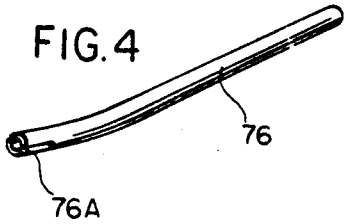
FIG. 4 illustrates a preferred embodiment of a leverage bar in accordance with the present invention.

As is illustrated in FIG. 4, the preferred embodiment of the transmission stand 2 further comprises a leverage bar 76. The leverage bar 76 includes a distal end 76A shaped in such a manner that it can be snugly received by the biceps portion 70A of the elbow 70.

Figure 5:
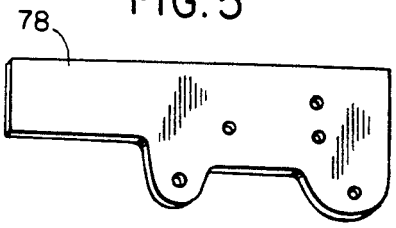
FIG. 5 is a perspective view of a preferred adaptor plate in accordance with the present invention.
Figure 2:
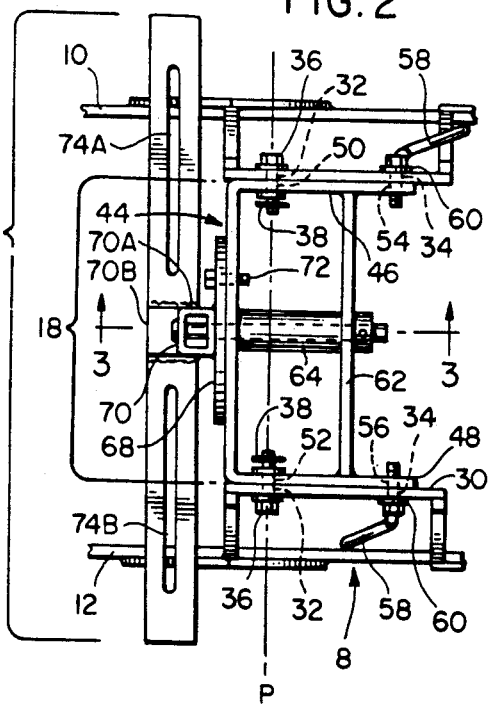
FIG. 2 is a top view of the preferred embodiment illustrated in FIG. 1.
Figure 3:
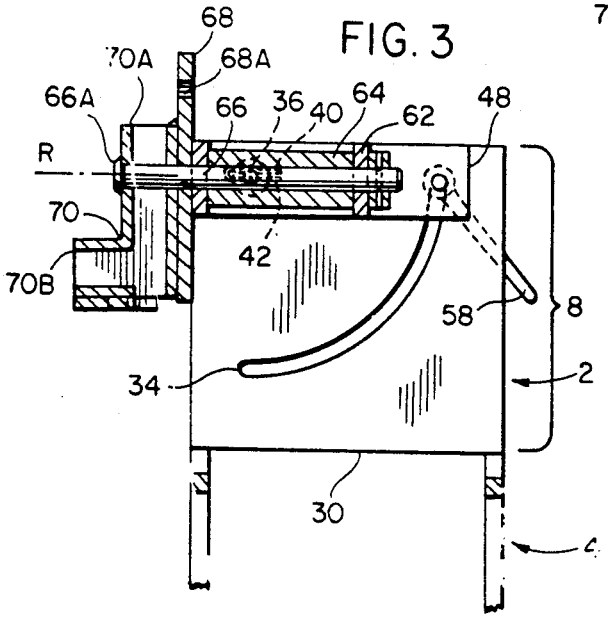
FIG. 3 is a cross section taken along line 3—3 of FIG. 2.

With reference to FIG. 5, an adaptor plate 78 is illustrated having a shape which conforms to the bell housings of Ford, General Motors, American Motors, Chrysler, and other brand transmissions. The adaptor plate 78 includes a plurality of holes arranged according to the location of the mounting bolts on each of the foregoing transmissions. According to a preferred embodiment, the adaptor plate 78 is 16–22 inches long and 4–7 inches wide.

A preferred use of the present invention will now be described with reference to FIGS. 6–8.

Figure 6:
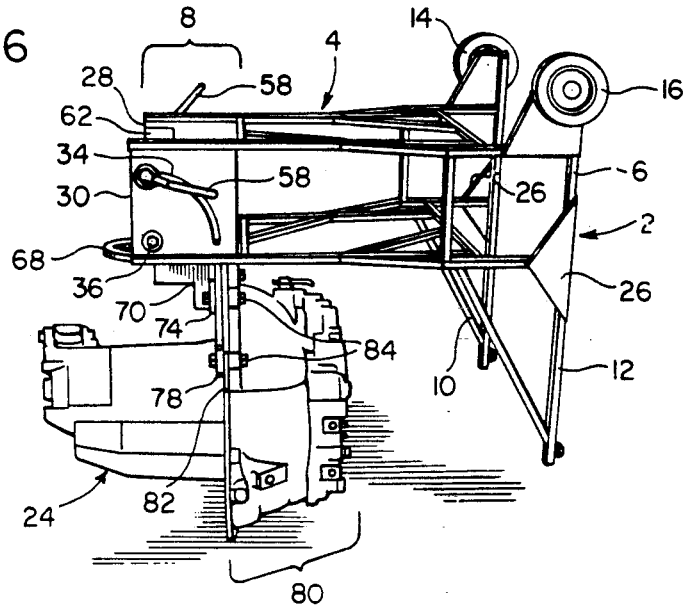
FIG. 6 illustrates the transmission stand in a generally horizontal position prior to lifting a transmission from the ground.
Figure 7:
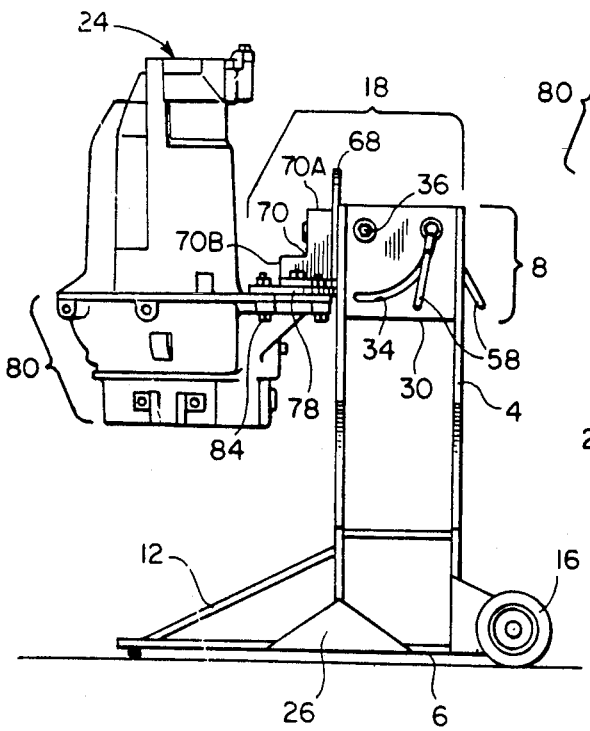
FIG. 7 illustrates the transmission stand in the upright position, after having lifted the transmission.

With reference to FIG. 6, the bell housing 80 of a typical transmission 24 includes a support bracket 82 with holes for receiving mounting bolts 84. The transmission 24 is initially positioned on the floor of a shop, with the transmission stand 2 positioned just above the transmission 24. The attachment means 18 is positioned immediately above the mounting bolts 84 of the bell housing 80, while the framework 4 is supported by the leg members 10 and 12.

In order to secure the transmission 24 to the attachment means 18, the adaptor plate 78 must first be sandwiched between the transmission support bar 74 and the mounting bracket 82 of the bell housing 80. In particular, the adaptor plate 78 is positioned such that at least two of the holes therein, align with the mounting holes of the bell housing 80. The same or other holes in the adaptor plate 78 are then aligned with the slots 74A and 74B in the transmission support bar 74. Once the adaptor plate 78 is positioned accordingly, the transmission's mounting bolts 84 are inserted through the bell housing 80 for engagement with the adaptor plate 78. Likewise, additional bolts are passed through the support bar and received in the adaptor plate 78 holes which did not align with the mounting bracket 82 but did align with the support bar slots 74A and 74B. Consequently, the transmission 24 is attached securely to the adaptor plate 78 and the adaptor plate 78 is attached securely to the support bar 74. The transmission 24 is thus secured to the pivotally mounted attachment means 18.

Next, by using the leg members 10 and 12 as a fulcrum, the transmission stand 2 is rotated to an upright position. This upright position is illustrated in FIG. 7 of the drawings. Such use of the leg members 10 and 12 as a fulcrum advantageously reduces the level of back strain involved in lifting the transmission 24 to an elevated position. With reference to FIG. 7, the forwardly extending leg members 10 and 12 prevent tipping of the transmission stand 2 after the transmission stand is uprighted.

Next, if it becomes necessary to work on the bell housing side (forward side) of the transmission 24, the transmission can be rotated with relative ease. In particular, the disk-tightening bolt 72 is loosened using counter-clockwise rotations, the transmission 24 is then rotated to a desired angular orientation along with the disk 68 and shaft 66, and the disk-tightening bolt 72 is thereafter tightened to secure the transmission 24 in the desired angular orientation.

Figure 8:
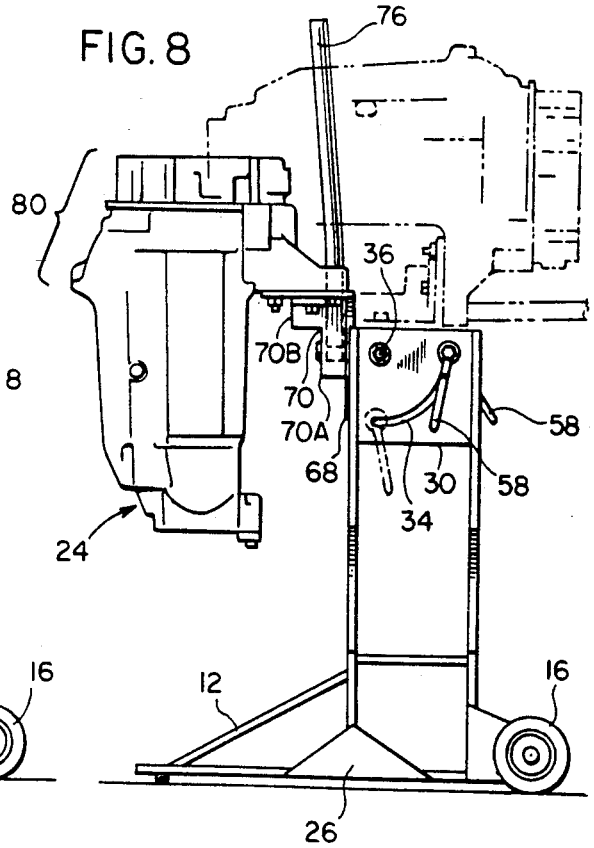
FIG. 8 illustrates the transmission after having been rotated 180 degrees on the stand, and in phantom lines, shows the transmission stand after an attachment means thereof has been pivoted 90 degrees.

The solid lines in FIG. 8 illustrate the transmission 24 after being rotated 180 degrees so that the bell housing 80 is now on top.

Next, if it becomes necessary to remove the transmission pan or otherwise work on the lower side of the transmission 24, the entire attachment means 18 and the transmission 24 can be pivoted so that the transmission 24 ends up inverted on top of the head portion S. Specifically, this is accomplished by first inserting the leverage bar 76 into the biceps portion 70A of the elbow 70, as is illustrated in FIG. 8. Next, the handled bolts 58 are loosened on each side of the head portion 8. Once both handled bolts 58 are loosened, the leverage bar 76 is used to pivot the transmission 24 into the positioned shown in the phantom lines of FIG. 8. After the transmission 24 and attachment means 18 have been pivoted, the handled bolts 58 can be re-tightened, and work on the lower side of the transmission 24 can commence.

Next, if it desired to move the transmission 24 to a different location, the framework 4 can be tilted back until the entire structure is supported by the wheels 14 and 16. Thereafter, the transmission 24 can be "dollied" to the desired location.

Although the present invention has been described in connection with a specific embodiment and use thereof, it will be understood that the present invention is capable of further modifications, uses or adaptations following in general, the principals of the invention and including such departures from the present disclosure as come within known or customary practice in the art to which the invention pertains.

I claim:

1. A transmission stand for supporting transmissions, said transmission stand comprising:

a framework having a head portion and a base portion;

at least two leg means projecting forward from said base portion for stabilizing the transmission stand when the transmission stand is upright, each of said at least two leg means comprising a distal tip which acts as a fulcrum when the transmission stand is rotated from a generally horizontal position to an upright position and vice versa; and attachment means pivotally mounted to said head portion of the framework, said attachment means being pivotally adjustable about a pivot axis from a position generally forward to the head portion to a position generally on top of the head portion, said attachment means having means for supporting the bell housing of a transmission.

said head portion further comprising two laterally disposed head plates, each of said head plates having a hole disposed toward a forward and upper corner of the head plate and an arced slot disposed at a constant radius from said hole, said attachment means further comprising:

a generally U-shaped member having a base and two substantially parallel branches extending out from opposite ends of said base, each of said branches having a distal hole and pivot hole, said U-shaped member being pivotally attached between said head plates by a pair of pivot pins which extend through said pivot holes, the distance separating said pivot holes from said distal holes being equal to the radial distance separating the arced slots and the hole in each head plate;

a cross beam extending transversely across said U-shaped member, said cross beam being substantially parallel to the base of said U-shaped member;

a tubular member bisecting said U-shaped member; said tubular member being supported at one end by the cross beam and at another end by the of the U-shaped member;

a shaft rotatably received in said tubular member, one end of said shaft extending out of said tubular member beyond the base of said U-shaped member;

a disk member having a radial center connected to said one end of said shaft, said disk member being rigidly connected to a transmission support bar for supporting the bell housing of a transmission; and a frictional engaging means connected to said disk member, for selectively causing said disk member to fictionally engage said base of said U-shaped member to thereby prevent rotation of said shaft with respect to said tubular member.

2. The transmission stand of claim 1, and further comprising an adaptor plate for adapting the transmission stand to accommodate more than one brand of transmission.

3. The transmission stand of claim 2, wherein said adaptor plate comprises a substantially flat plate having adaptor holes which align with the mounting holes of at least two different brands of transmissions.

4. The transmission stand of claim 1, and further comprising a leverage bar which can be connected to said attachment means, for providing leverage when said attachment means is to be pivoted from a position generally forward of the head portion to a position generally on top of the head portion and vice versa.

5. The transmission stand of claim 1, and further comprising elbow means for fixedly connecting said shaft and disk member to said transmission support bar.

6. The transmission stand of claim 1, and further comprising locking means for selectively preventing pivotal movement of said attachment means, said locking means extending through said arced slots in said head plates and engaging said distal holes in said U-shaped member.

7. The transmission stand of claim 6, wherein said locking means comprise at least one bolt which, when tightened by rotation, causes said head plate to frictionally engage said U-shaped member thus preventing further pivoting of said attachment means.

8. The transmission stand of claim 1, and further comprising at least one rear wheel connected to the base portion of said framework, for allowing the transmission stand to be used as a dolly.

9. A transmission stand for supporting front wheel drive transmissions, said transmission stand comprising:

a generally rectangular framework having a head portion and a base portion;

at least two generally triangular leg means projecting forward from said base portion for stabilizing the transmission stand when the transmission stand is upright, each of said at least tow leg means comprising a distal tip which acts as a fulcrum when the transmission stand is rotated from a generally horizontal position to an upright position and vice versa;

a pair of rear wheels mounted laterally to the base portion of the framework, for allowing the transmission stand to be used as a dolly;

a pair of head plates defining the lateral sides of the head portion, each of said head plates comprising a hole located toward an upper and forward corner of the head plate and an arced slot positioned at a constant radial distance from said hole;

a generally U-shaped member having a base and two substantially parallel branches extending out from opposite ends of said base, each of said branches having a distal hole and pivot hole, said U-shaped member being pivotally attached between said head plates by a pair of pivot pins which extend through said pivot holes, said U-shaped member being pivotally adjustable from a position generally forward of the head portion to a position generally on top of the head portion, the distance separating the pivot holes from said distal holes being equal to the radial distance separating the arced slot from the hole in each head plate;

a rotational member having a radial center rotationally connected to the base of said U-shaped member; and means for supporting the bell housing of a transmission, connected fixedly to said rotational member.

10. The transmission stand of claim 9, and further comprising a frictional engaging means connected to said rotational member, for selectively causing said rotational member to frictionally engage said base of said U-shaped member to thereby prevent rotation of said rotational member with respect to said U-shaped member.

11. The transmission stand of claim 9, and further comprising locking means for selectively preventing pivotal movement of said U-shaped member, said locking means extending through said arced slots in said head plates and engaging said distal holes in said U-shaped member.

12. The transmission stand of claim 9, wherein said locking means comprise at least one bolt which, when tightened by rotation, causes said head plate to frictionally engage said U-shaped member thus preventing further pivoting of said U-shaped member.

13. The transmission stand of claim 9, and further comprising a leverage bar which can be connected to said rotational means, for providing leverage when said U-shaped member is being pivoted from a position generally forward of the head portion to a position generally on top of the head portion and vice versa.

14. The transmission stand of claim 9, and further comprising an adaptor plate for adapting the transmission stand to accommodate more than one brand of transmission.

15. The transmission stand of claim 14 , wherein said adaptor plate comprises a substantially flat plate having adaptor holes which align with the mounting holes of at least two different brands of transmissions.

16. The transmission stand of claim 9, wherein each of said leg means includes a distally located rubber pad.

* * * * *